United States Patent [19]

Braun et al.

[11] 4,403,808

[45] Sep. 13, 1983

[54] HAULING AND SHAVING PLANT

[75] Inventors: Gert Braun; Ernst Braun, both of Essen-Heisingen, Fed. Rep. of Germany

[73] Assignee: Halbach and Braun, Fed. Rep. of Germany

[21] Appl. No.: 182,801

[22] Filed: Aug. 29, 1980

[30] Foreign Application Priority Data

Sep. 12, 1979 [DE] Fed. Rep. of Germany ..... 2936819

[51] Int. Cl.[3] ..... E21C 27/32

[52] U.S. Cl. ..... 299/34; 299/43

[58] Field of Search ..... 299/34, 42, 43

[56] References Cited

U.S. PATENT DOCUMENTS 3,285,662 11/1966 Löbbe ..... 299/34

4,154,479 5/1979 Braun ..... 299/34

4,248,482 2/1981 Truszczinski ..... 299/34

FOREIGN PATENT DOCUMENTS 1179167 10/1964 Fed. Rep. of Germany ..... 299/34

*Primary Examiner*—William F. Pate, III

*Attorney, Agent, or Firm*—McGlew and Tuttle

[57] ABSTRACT

A hauling and shaving plant for underground mining of a mining face particularly a coal face which is adjacent a rock face disposed at an angle thereto comprises a longwall conveyor section which is adapted to be positioned alongside the coal face and a rock face section extending at an angle to the longwall conveyor section. A plane guide is associated with the conveyor and a plane is movable along the guide. A shaving chain guide is associated with the plane guide in the conveyor. A plane chain is connected to the plane and is movable along the plane guide. The hauling chain has a pulling strand and a return strand and is guided along the longwall conveyor. The shaving chain and the hauling chain are driven by drives which are located adjacent the rockwall section. The conveyor includes at least one deflecting pulley over which the pulling strand is directed and at least one return pulley over which the return strand is directed. The return strand is also guided adjacent the rock face in a return channel. A chain channel is located in the rockwall section and extends at an angle to the conveyor alongside the rock face and the pulling strand is directed along the chain channel. The return strand is directed from the longwall conveyor into the chain channel at the coal face end.

5 Claims, 3 Drawing Figures

HAULING AND SHAVING PLANT

FIELD AND BACKGROUND OF THE INVENTION

This invention relates in general to the construction of mining equipment and in particular to a new and useful hauling and shaving plant for underground mining.

The invention concerns a hauling and shaving plant in underground mining, with a longwall conveyor extending up to a head zone in front of a coal face, with a plane guide at the coal face end and a coal plane guided thereon, where the longwall conveyor carries at its head and foot a driving unit for the hauling chain and the shaving chain, and where the driving units for the hauling chain and the shaving chain are arranged at the rock face end.

Hauling and shaving plants for drawing hook planes are known, where not only the driving unit for the hauling chain, but also for the shaving chain, as well as the plane guide are arranged at the rock face end, and the pulling strand as well as the return strand of the shaving chain are guided in chain channels at the rock face end.

In addition, hauling and shaving plants are known for gliding planes where the driving unit for the shaving chain and the plane guide are guided at the coal face end and correspondingly the pulling strand and the return strand of the shaving chain in chain channels at the rock face end. A problem in these hauling and shaving plants is that the coal plane cannot be moved in the drift region along the coal face because of the driving and guide mechanism, so that a dead region, remains in the transition range from the longwall to the head drift, which must be cleared manually. In order to avoid these inconveniences, an older patent of the applicant provides to arrange the driving unit for the shaving chain at the rock face end, even in hauling and shaving plants for gliding conveyors. But even in this embodiment, pulling strand and return strand of the shaving chain run in chain channels of the plane guide at the coal face end. Of the two superposed chain channels, the bottom chain channel for the return strand is relatively difficult to access, because it is only open on the longwall conveyor end toward the footwall. Though this type of chain guidance is acceptable, it still needs improvement in case of a chain break in the return strand, that is, in the bottom part of the chain channel.

Because in such a case the return strand of the shaving chain should be relatively easily accessible for the necessary repairs.

SUMMARY OF THE INVENTION

The invention provides a hauling and shaving plant with gliding planes, which is characterized by a readily accessible chain guide for the return strand of the shaving chain, so that repairs can be made simply and rapidly in case of a chain break.

In accordance with the invention, the longwall conveyor has, at least at its head and at the coal face end, a deflecting pulley for the pulling strand; and, at the rock face end, a deflecting pulley for the return strand of the shaving chain. The return strand is guided in a return channel on the longwall conveyor at the rock face end and is deflected at the foot of the longwall conveyor in the chain channel provided for the pulling strand at the coal face end. These measures have the effect that the return strand of the shaving chain is no longer guided in the bottom chain channel of the plane guide arranged at the coal face end, but in a return channel at the rock face end which is therefore, easier of access. This return of the return strand of the shaving chain at the rock face end is made possible by the arrangement of the driving unit for the coal plane working as a gliding plane at the rock face end. The bottom chain channel remains unchanged in the plane guide at the coal face end, and takes over the function of a supply channel for cables, water and if necessary, compressed air pipes. According to a special embodiment of the invention, which is of particular importance in combination with the claimed measures, the driving unit for the coal plane is arranged with a given distance from the longwall conveyor in the longwall at the rock face end. This arrangement of the plane drive makes it possible to set the support e.g. the shock or shield type support directly behind the longwall conveyor at the rock face end. In this way, the driving unit for the coal plane is not the way.

With the invention the deflecting pulley is arranged at the coal face end at the level of the chain channel for the pulling strand, and the deflecting pulley is arranged at the rock face end at the level of the return channel for the return strand of the shaving chain. This results automatically in a vertical adjustment when the pulling strand passes over at the head via the driving wheel of the plane drive into the return channel as a return strand. The shaving chain can be guided in a chain tunnel in the transition conveyor to the driving units at its head in order to obtain a protected chain guide in this region too.

Furthermore, the invention provides that the longwall conveyor has, at its foot with its auxiliary drive, a single deflecting pulley or a deflecting pulley at the rock face and the coal face end for transferring the return strand from the return channel to the chain channel for the pulling strand. The return channel makes the return strand of the shaving chain readily possible because it is arranged at the rock face end on the longwall conveyor. Besides the return channel can have at its rock face end an assembly slot covered with cover plates.

The advantages achieved with the invention are seen substantially in that a hauling and shaving plant for a guiding conveyor is provided in underground mining, where not only the pulling strand, but also the return strand of the shaving chain are readily accessible in order to permit the repairs necessary in a chain break in a simple and rapid manner. To this end the return strand of the shaving chain is arranged in a return channel at the rock face end while the bottom chain channel in the plane guide at the coal face end, which has served heretofore only to receive the return strand, is now used as a supply channel to receive the supply lines. At the same time the arrangement of the plane drive and of the driving unit for the shaving chain at the rock face end is such that the support can still be set directly behind the longwall conveyor.

Accordingly, it is an object of the invention to provide a hauling and shaving plant for underground mining of a mining face particularly a coal face located adjacent a rock face which is disposed at an angle thereto and which includes a longwall conveyor section and a rock wall conveyor section with the longwall conveyor section including a plane guide with a plane movable thereover which is connected to a shaving chain and also including a hauling chain and a guide therefor, the drive units for the shaving and hauling chains being located adjacent the rockwall including at least one deflecting pulley over which the shaving chain is directed, at least one return pulley over which the return strand is directed and a return channel in which the return strand is guided along the rock face.

A further object of the invention is to provide a hauling and shaving plant which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1, 2, 3:
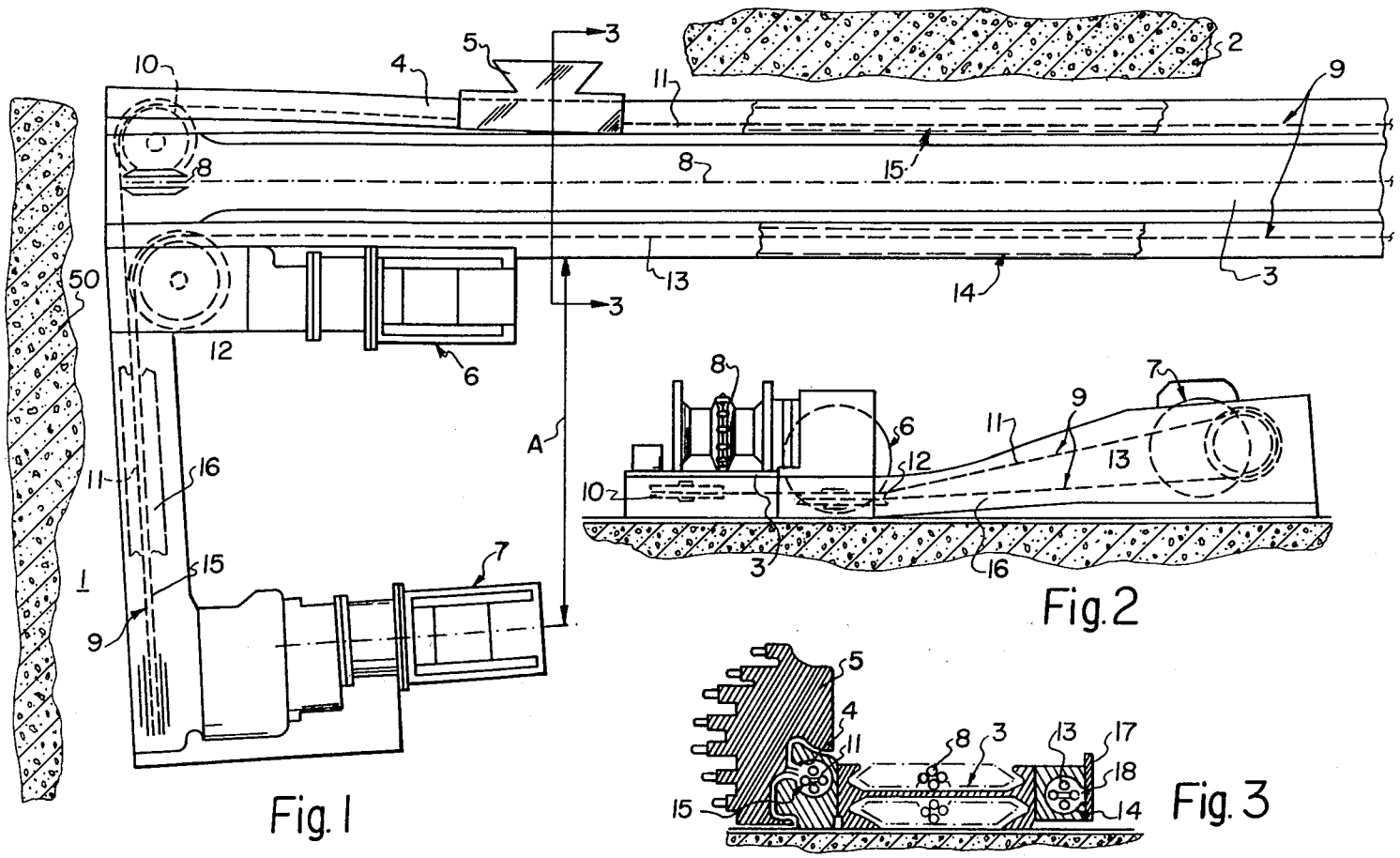
FIG. 1 is a schematic top plan view of a hauling and shaving plant constructed in accordance with the invention, but without indicating the foot end of the longwall conveyor.
FIG. 2 is a side elevational view of the conveyor shown in FIG. 1.
FIG. 3 is a vertical section of the conveyor shown in FIG. 1 taken along the line 3—3.

Referring to the drawings, in particular the invention embodied therein comprising a hauling and shaving plant for underground mining of a mining face such as a coal face 2 which is adjacent a rock face 50 which is disposed in an angle thereto. A plane for planing the coal face 5 is guided along a plane guide 4 associated with the longwall conveyor 3 along a head zone. A hauling chain 8 is guided by suitable guide pulleys of the conveyor 3. In addition a shaving chain 9 including a pulling strand section 11 and a return section 13 are associated with the longwall conveyor. The longwall conveyor 3 includes at least one deflecting pulley 10 over which the shaving chain pulling strand 11 is directed and at least one return pulley 12 over which the return strand 13 is directed and which are located adjacent the rock face. A return channel 14 is defined along the return strand section for guiding the return strand. In addition, a chain channel 16 is defined along the rockwall section and extends at an angle to the longwall conveyor 3.

The figures show a hauling and shaving plant for underground mining, with a longwall conveyor 3 extending up to a head zone 1 in front of a coal face 2, with a plane guide 4 at the coal face end, and a coal plane 5 guided thereon, namely a gliding plane, where longwall conveyor 3 has at its head and foot driving units 6 and 7 for a hauling chain 8 and shaving chain 9 at the rock face end. Longwall conveyor 3, has at least at its head, at the coal face end, a deflecting pulley 10 for pulling strand 11, and at the rock face end a deflecting pulley 12 for return strand 13 of shaving chain 9. Return strand 13 is guided in a return channel 14 on longwall coneyor 3 at the rock face end, and at the foot of the longwall conveyor 3 in chain channel 15 at the face end provided for the pulling strand. The driving unit 7 for shaving chain 9 and coal plane 5 is arranged in the longwall at the rock face end with the given distance "A" from longwall conveyor 3. Deflecting pulley 10 at the coal face end is arranged at the level of chain channel 15 for pulling strand 11, deflecting pulley 12 at the rock face end is arranged at the level of return channel 14 for return strand 13 of shaving chain 9. Shaving chain 9 is conducted to its driving unit 7 at the head in a chain channel 16. Longwall conveyor 3 has at its foot either a single deflecting pulley (not shown) or a deflecting pulley 12 at the rock face, and a deflecting pulley 10 at the coal face end, to transfer return strand 13 from return channel 14 to chain channel 15 for pulling strand 11. Return channel 14 has at the rock face end an assembly slot 16 covered by cover plate 17, to make return strand 13 of the shaving chain readily accessible in case of a chain break.

While specific embodiments of the invention have been shown and described in detail to illustrate the application of the principles of the invention, it will be understood that the invention may be embodied otherwise without departing from such principles.

What is claimed is:

1. A hauling and planing plant for underground mining of a mining face, particularly a coal face which is adjacent a rock face and disposed at an angle thereto, comprising a longwall conveyor section adapted to be positioned alongside the coal face, a plane guide associated with said longwall conveyor, a plane movable along said plane guide, a plane chain guide associated with said longwall conveyor, a plane chain connected to said plane and movable along said guide, a rock wall section extending at an angle from said longwall conveyor along a head zone, a hauling chain having a pulling strand and a return strand guided along said longwall conveyor, a plane chain and hauling chain drive unit connected to said hauling chain and said plane chain and arranged adjacent said rock wall section, said longwall conveyor including at least one deflecting pulley over which said hauling chain pulling strand is directed and at least one return pulley over which said hauling chain pulling strand is directed located adjacent said rock wall section, means defining a return channel in said longwall conveyor in which said return strand is guided adjacent said rock face end, and a chain channel in said rock wall section extending at an angle to said longwall conveyor along said rock face in which said pulling strand is directed, said driving unit for said shaving chain being arranged in said rock section at a selected spacing from said longwall conveyor.

2. A hauling and shaving plant according to claim 1, including a chain channel guide extending at an angle to said longwall conveyor, a pulling strand guided in said channel guide, said deflecting pulley being arranged at the level of said chain channel for the pulling strand and a deflecting pulley at the rock end face at the level of the return channel for the return strand of the shaving chain.

3. A hauling and shaving plant according to claim 1, including a chain tunnel defining a guide for said shaving chain in a transition range from the longwall conveyor to its driving unit (7) at said head.

4. A hauling and planing plant for underground mining of a mining face, particularly a coal face which is adjacent a rock face disposed at an angle thereto, comprising a longwall conveyor section adapted to be positioned alongside the coal face, a plane guide associated with said longwall conveyor, a plane movable along said plane guide, plane chain guide associated with said longwall conveyor, a plane chain connected to said plane and movable along said guide, a rock wall section extending at an angle from said longwall conveyor along a head zone, a hauling chain having a pulling strand and a return strand guided along said longwall conveyor along a head zone, a plane chain and hauling chain drive unit connected to said hauling chain and said plane chain and arranged adjacent said rock wall section, said longwall conveyor including at least one deflecting pulley over which said hauling chain pulling strand is directed, and at least one return pulley over which said hauling chain pulling strand is directed located adjacent said face, means defining a return channel in said longwall conveyor in which said hauling chain return strand is guided adjacent said rock face end, and a chain channel in said rock wall section extending at an angle to said longwall conveyor along said rock face in which said hauling chain pulling strand is directed, said longwall conveyor having said at least one deflecting pulley comprising, at its foot, a single deflecting pulley, and at its rock face, a second deflecting pulley to transfer the hauling chain return strand from the return channel to said return channel for the plane strand.

5. A hauling and planing plant for underground mining of a mining face, particularly a coal face which is adjacent a rock face disposed at an angle thereto, comprising a longwall conveyor section adapted to be positioned alongside the coal face, a plane guide associated with said longwall conveyor, a plane movable along said plane guide, a plane chain guide associated with said longwall conveyor, a plane chain connected to said plane and movable along said guide, a rock wall section extending at an angle from said longwall conveyor along a head zone, a hauling chain having a pulling strand and a return strand guided along said longwall conveyor, a plane chain and hauling chain drive unit connected to said hauling chain and said planing chain and arranged adjacent said rock wall section, said longwall conveyor including at least one deflecting pulley over which said hauling chain pulling strand is directed, and at least one return pulley over which said hauling chain return strand is directed located adjacent said face, means defining a return channel in said longwall conveyor in which said hauling return strand is guided adjacent said rock face end, and a chain channel in said rock wall section extending at an angle to said longwall conveyor along said rock face in which said hauling chain pulling strand is directed, said return channel having at the rock face end an assembly slot covered by cover plates.

* * * * *